US012618571B2

(12) United States Patent
Pandelidis

(10) Patent No.: US 12,618,571 B2
(45) Date of Patent: May 5, 2026

(54) TWO-PHASE PRE-COOLING METHOD FOR AIR CONDITIONING SYSTEM

(71) Applicant: Baryon Inc., Wilmington, DE (US)

(72) Inventor: Demis Łukasz Pandelidis, Wroclaw (PL)

(73) Assignee: BARYON INC., Wilmington, DE (US)

( * ) Notice: Subject to any disclaimer, the term of this patent is extended or adjusted under 35 U.S.C. 154(b) by 200 days.

(21) Appl. No.: 17/987,063

(22) Filed: Nov. 15, 2022

(65) Prior Publication Data

US 2023/0151979 A1 May 18, 2023

Related U.S. Application Data

(60) Provisional application No. 63/279,528, filed on Nov. 15, 2021.

(51) Int. Cl.
*F24F 6/04* (2006.01)
*F24F 12/00* (2006.01)

(52) U.S. Cl.
CPC ..... *F24F 6/04* (2013.01); *F24F 12/006* (2013.01)

(58) Field of Classification Search
CPC .. F24F 6/04; F24F 6/043; F24F 5/0035; F24F 12/006; F24F 3/14
See application file for complete search history.

(56) References Cited

U.S. PATENT DOCUMENTS 4,713,943 A 12/1987 Wainwright
4,977,753 A 12/1990 Maisotsenko et al.
5,212,956 A 5/1993 Tsimerman
6,612,365 B1 * 9/2003 Saishu ..... F24F 12/006 165/47
2002/0038552 A1 4/2002 Maisotsenko et al.
2004/0134211 A1 * 7/2004 Lee ..... F24F 12/006 62/271
2009/0044555 A1 2/2009 Park
2012/0255705 A1 * 10/2012 Wallin ..... F24F 3/147 165/104.13
2014/0041833 A1 * 2/2014 Breshears ..... F24F 12/006 165/104.11
2017/0276383 A1 * 9/2017 Gilbert ..... F28D 5/00

FOREIGN PATENT DOCUMENTS

AT 009239 U1 6/2007
CN 104990177 A 10/2015
KR 10-2016-0037387 A 4/2016

OTHER PUBLICATIONS

"moisture". https://dictionary.cambridge.org/dictionary/english/moisture Accessed May 11, 2025.*
Collins Dictionaries (Ed.). (2014). Moisture. In Collins English Dictionary (12th ed.). Collins. https://search.credoreference.com/articles/Qm9va0FydGljbGU6MzYxNDY2OQ==?aid=279753.*
International Search Report and Written Opinion filed in PCT/US2022/049886; filed on Mar. 27, 2023; 9 pgs.
Extended European Search Report filed in EP 22893726.4, issued on Nov. 17, 2025; 9 pgs.

* cited by examiner

*Primary Examiner* — Tavia Sullens
(74) *Attorney, Agent, or Firm* — Vedder Price P.C.

(57) ABSTRACT

The present disclosure relates to a system and method of controlling the temperature and humidity of a conditioned space. The method and system are based on the two-phase pre-cooling of an airflow prior to dehumidification, wherein the airflow passes through a heat exchanger which initially cools and dehumidifies the air before it enters the dehumidifier for additional dehumidification.

19 Claims, 2 Drawing Sheets

TWO-PHASE PRE-COOLING METHOD FOR AIR CONDITIONING SYSTEM

CROSS-REFERENCE TO OTHER APPLICATION

This Application claims the benefit of and priority to U.S. Provisional Application No. 63/279,528 filed Nov. 15, 2021, the content of which is hereby incorporated by reference.

FIELD OF THE DISCLOSURE

The present disclosure relates to systems and methods for improving the efficiency and effectiveness of existing dehumidifiers.

BACKGROUND OF THE DISCLOSURE

Air conditioning systems generally provide some amount of dehumidification of air as part of the cooling process. These systems can be used to cool air already within an enclosed, conditioned space. Alternatively, such systems can be used to cool external air prior to introducing it to a conditioned space. However, such systems generally are inefficient and as a result, when external air is introduced into a conditioned room, the external air can introduce significant amounts of moisture that the air conditioning system may be unable to quickly or fully address. This introduction of external, humid air increases the perceived temperature of the conditioned space and decreases the comfort of individuals therein.

These problems are typically mitigated by using a separate dehumidification process (beyond the cooling system) on the external air prior to introducing the air to a conditioned room. However, such dehumidification processes are generally inefficient and require the expenditure of significant amounts of additional energy.

Thus, there exists a long-felt and currently unmet need for a system which allows for the more efficient dehumidification of external air prior to introducing it to a conditioned space.

SUMMARY OF THE DISCLOSURE

The present disclosure relates to systems and methods of controlling the temperature and humidity of a defined space. More specifically, the present disclosure is directed to systems and methods employing a two-phase process for pre-cooling air prior to dehumidification. In an embodiment of the present disclosure, external air is passed through a dry channel of a heat exchanger for pre-cooling prior to undergoing dehumidification. Any additional energy requirements for the heat exchanger are reduced or eliminated by simultaneously passing conditioned air through a wet channel of the heat exchanger prior to venting the conditioned air to the environment. Liquid in the wet channel evaporates into the exhausted, conditioned air, cooling the channel. The wet channel is thermally coupled to the dry channel, thereby cooling the dry channel and initially cooling and dehumidifying the external air before it enters the dehumidifier for additional dehumidification.

BRIEF DESCRIPTION OF THE DRAWINGS

The following detailed description, given by way of example, but not intended to limit the disclosure solely to the specific embodiments described, may best be understood in conjunction with the accompanying drawings.

DETAILED DESCRIPTION OF THE DISCLOSURE

Figure 1:
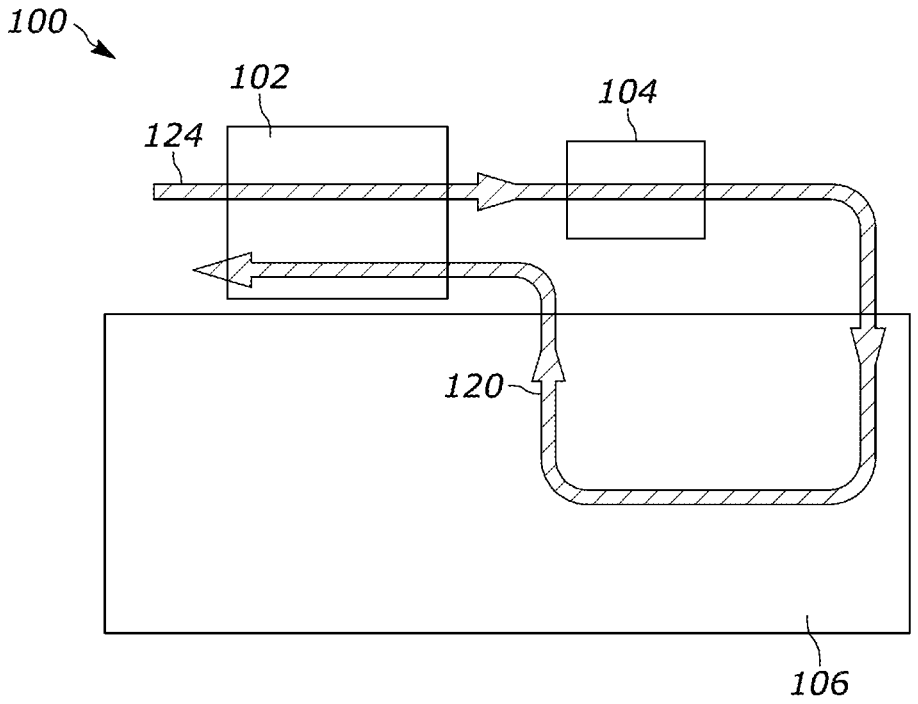
FIG. 1 shows a diagram of the air conditioning system comprising a heat exchanger, dehumidifier, conditioned room, and the airflow into and out of the system.

For the purposes of promoting and understanding the principles disclosed herein, reference is now made to the preferred embodiments illustrated in the drawings, and specific language is used to describe the same. It is nevertheless understood that no limitation of the scope of the invention is hereby intended. Such alterations and further modifications in the illustrated devices and such further applications of the principles disclosed and illustrated herein are contemplated as would normally occur to one of skill in the art to which this disclosure relates.

The inventors of the present disclosure have created a new method for controlling the air temperature, air flow, and humidity of a space which comprises an air conditioning system 100.

FIG. 1 shows an air conditioning system 100 for a conditioned room 106 in accordance with an embodiment of the present disclosure. As shown, the air conditioning system 100 comprises a heat exchanger 102 and a dehumidifier 104. The heat exchanger 102 and dehumidifier 104 are coupled together such that air is passed from the heat exchanger 102 to the dehumidifier 104. The dehumidifier 104 is in turn coupled to the conditioned room 106. In the embodiment shown in FIG. 1, the heat exchanger 102 and dehumidifier 104 and the dehumidifier 104 and conditioned room 106 are coupled together, respectively, using pipes, ductwork, or another physical linkage that is generally impermeable to air such that substantially all of the air that passes through the heat exchanger 102 is received by the dehumidifier 104 and substantially all of the air received by the dehumidifier 104 is passed on to the room 106.

As shown, the heat exchanger 102 receives and pre-cools outdoor air 124. During pre-cooling, the temperature of the air 124 is reduced, thereby causing water vapor in the air to condense into liquid form and removing water vapor from the air 124.

In an embodiment, the heat exchanger operates as both a passive heat exchanger 102 (as further described herein) while also including an active cooling system to further cool the air during the pre-cooling step.

After exiting the heat exchanger 102, the pre-cooled and partially dehumidified air is then passed through the dehumidifier 104, which further dehumidifies the pre-cooled air. The dehumidifier 104 may comprise a membrane dehumidifier, desiccant dehumidifier, mechanical compression dehumidifier, or such other form of dehumidification system that is known in the art. After further dehumidification, the air is passed from the dehumidifier 104 to the conditioned room 106.

In an alternative embodiment, the dehumidifier 104 may be omitted and the pre-cooled air may be passed directly from the heat exchanger 102 to the conditioned room 106. In a second alternative embodiment, the dehumidifier 104 may be combined with the heat exchanger 102 such that a single device performs the functions of both as described herein.

In the embodiment shown in FIG. 1, the conditioned room 106 accepts the dehumidified and pre-cooled air from the dehumidifier 104. The air then passes through the room at the desired temperature before exiting the room as exhaust 120.

In alternative embodiments, an additional cooling system may be employed to further cool the air prior to introduction into the conditioned space 106 and/or to cool air within the conditioned space. In one such alternative embodiment, a separate air conditioning system (such as a central air conditioner) cools air within the conditioned space. In another such alternative embodiment, a further air conditioning system is employed to further cool the pre-cooled air before it is introduced into the conditioned space.

As shown, air from the conditioned room 106 is expelled from the conditioned room 106 as exhaust 120. The exhaust 120 is passed through the heat exchanger 102 before being released into another environment. In embodiments, fresh external air is continuously brought into the conditioned space while a corresponding volume of exhaust 120 is expelled, such that the pressure in the conditioned room 106 is maintained substantially unchanged while constantly ventilating the conditioned space.

Figure 2:
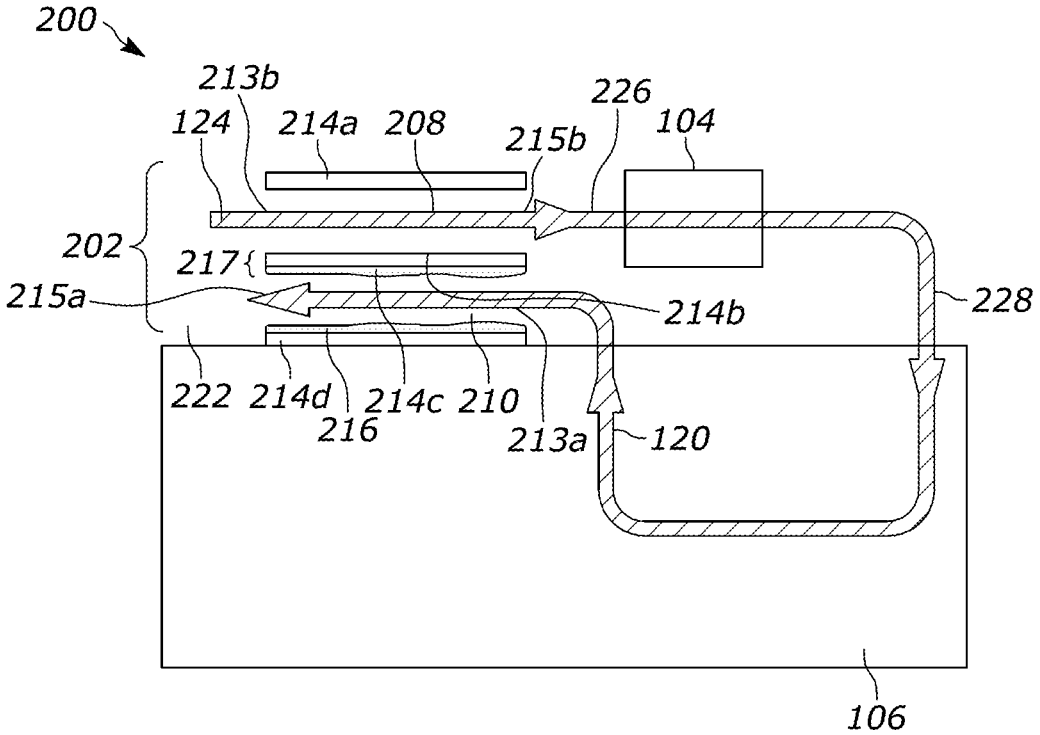
FIG. 2 displays a first embodiment of the system of FIG. 1 comprising a heat exchanger with a plurality of channels.

FIG. 2 shows an embodiment of a system 200 comprising a heat exchanger 202 comprising at least one dry channel 208 and at least one wet channel 210. Hereafter, use of the singular version of "dry channel" and "wet channel" comprise both the plural or singular use of these terms.

In the embodiment shown in FIG. 2, external air is pulled into and passes through the dry channel 208 before being provided to the dehumidifier 104. Similarly, the exhaust 120 is passed through the wet channel 210 before being expelled. The walls of the dry channel 214*a*, 214*b* and the walls of the wet channel 214*c*, 214*d* are thermally coupled, such that a change in temperature of any one wall 214 results in a corresponding change of temperature of the other walls 214. In the embodiment shown, the surfaces of the walls of the wet and dry working channels may be connected to form a shared wall made from a thermally conductive material 217. Each channel 208, 210 forms an enclosed space passing from a respective air inlet 213*a*, 213*b* to an air outlet 215*a*, 215*b*. Air flows from each inlet, through the respective channel, to the outlet. The walls 214*c*, 214*d* of the wet channel are coated in a liquid. In the embodiment shown, the walls 214*c*, 214*d* are coated in water. As exhaust 120 passes through the wet channel 210, water from the walls 214*c*, 214*d* evaporates, thereby reducing the temperature of the walls 214*c*, 214*d*. As the exhaust has already been conditioned, it will generally have a low moisture content and thus effectuate significant evaporation. As the walls of the wet channel 210 cool, heat is transferred from the dry channel 208 to the wet channel 210. External air passing through the dry channel 208 is thereby cooled through contact with the dry channel walls 214*a*, 214*b*, and results in condensation and removal of moisture from the air.

In the embodiment shown in FIG. 2, a fluid connection between the dry channel 208 and the wet channel 210 continuously replenishes the supply of liquid in the wet channel 210 with moisture derived from the air passing through the dry channel 208. In an alternative embodiment, the fluid connection is entirely passive, such that no external energy is needed to transport moisture from the dry channel 208 to the wet channel 210.

The dry channel 208 and wet channel 210 may be arranged in multiple configurations. As will be clear to one of skill in the art, combinations of these embodiments and other passive transport techniques may be used to effectuate the transfer of moisture from the dry channel 208 to the wet channel 210 while preventing backflow of moisture from the wet channel 210 to the dry channel 208. In an embodiment, the dry channel 208 is located above the wet channel 210 such that gravity effectuates the transfer of moisture from the dry channel 208 to the wet channel 210. In an alternative embodiment, the fluid connection is structured such that capillary action effectuates the transfer of moisture from the dry channel 208 to the wet channel 210. Regardless of the arrangement of the dry channel 208 and wet channel 210, the walls 214*a*, 214*b* of the dry channel 208 may be coated with a hydrophobic substance, such that water collecting thereon is driven through the fluid connection to the wet channel 210.

In an alternative embodiment, an active source is used, such as a pump or like means, to effectuate the transfer of moisture from the dry channel 208 to the wet channel 210. Alternatively, both active and passive mechanisms are combined to ensure continuous and efficient movement of water from the dry channel 208 to the wet channel 210.

In another embodiment of the disclosure shown in FIG. 2, an external source is used to replenish the water in the wet channel 210. The external source may comprise a connection to a local water supply and/or distilled water that is obtained from a reservoir.

In an embodiment, the heat exchanger 202 comprises a plurality of dry channels 208 and a plurality of wet channels 210. In an embodiment, each dry channel 208 is thermally coupled to a single wet channel 210. In an alternative embodiment, multiple dry channels 208 are thermally coupled to one or more wet channels. In a further embodiment, an alternating series of wet channels 210 and dry channels 208 are interspaced, such that the walls of each are thermally coupled together. In each of the embodiments described above, a channel plate may act as a wall of the heat exchanger 202 and serve to thermally couple the dry and wet channels 208, 210 together. In other embodiments, the channels 208, 210 are set in alternative arrangements that permit heat transfer between the channels.

Although the foregoing discussion refers to the dry channel 208 and wet channel 210 as having "walls" 214, it will be understood that any three-dimensional arrangement could be used. In an embodiment, the channels 208, 210 each comprise a cylinder. Substantially all of the wall of the wet channel 210 may be coated in water. Alternatively, the channels 208, 210 may comprise rectangular prisms. In such embodiment, only the "floor" of the wet channel may be coated in water. As will be clear to one of skill in the art, the cooling capacity of the system 200 may be selected by adjusting the number of channels 208, 210 and/or the area of contact between the walls 214 of the channels 208, 210 and the air passing through the channels 208, 210. Greater contact area will increase the amount of evaporation and/or condensation, thereby enabling both the degree of pre-cooling and the amount of dehumidification to be adjusted based on the desired capacity of the system.

In the preferred embodiment, the liquid 216 used in the wet working channel 210 is water. In alternative embodiments, any liquid may be used to facilitate heat transfer between the channels.

In the preferred embodiment of FIG. 2, exhaust air 120 exits the conditioned room 206 and is delivered to the wet working channel 210. As the exhaust air passes through the wet working channel 210, the exhaust air 120 absorbs the liquid 216 on the channel walls 214. The absorption of liquid 216 removes heat from the wet channel walls 214 and cools the shared wall 217. In turn, the shared wall 217 cools the dry working channel 208 as well as the outdoor air 124 passes through the dry working channel 208. As the outdoor air 124 cools, its moisture content is reduced. The partially cooled and dehumidified outdoor air 226 is then delivered to a dehumidifier 204 where it is further dehumidified. After passing through the dehumidifier, the outdoor air 228 is delivered to the condition 106 where it compensates the cooling and moisture loads in the conditioned room, before reaching the parameters for exhaust and exiting the conditioned room. The exhaust air 120 mixes with the outdoor ambient air 222 and is then delivered to the working channels 208, 210 (as outdoor air 124) and the cycle begins again.

The placement of the two-phase heat exchanger 202 before the dehumidifier 104 dramatically reduces the required capacity of the dehumidifier 104 because the bulk of the cooling and dehumidification process can occur during the pre-cooling process before the air reaches the dehumidifier 104. In embodiments, the degree of pre-cooling provided by the heat exchanger 202 entirely eliminates the need for subsequent dehumidification 204.

In an embodiment of the heat exchanger 202, the plates and walls 214 are comprised of a non-woven fabric, such as a Polyethylene Terephthalate (PET) non-woven fabric. In other embodiments, the plates and walls 214 are comprised of materials suitable for heat exchange which include but are not limited to metals and metal alloys, such as aluminum, copper, carbon steel, stainless steel, nickel alloys, and titanium. In another embodiment, the plates and walls 214 are comprised of ceramic material.

In an additional embodiment, the heat exchanger 202 may further comprise plates and walls 214 which provide an extended surface so as to increase the contact area between the air and water. In order to reduce a thickness of the liquid on the surface of the walls, the walls 214 may be coated with a hydrophilic surface.

Figure 3:
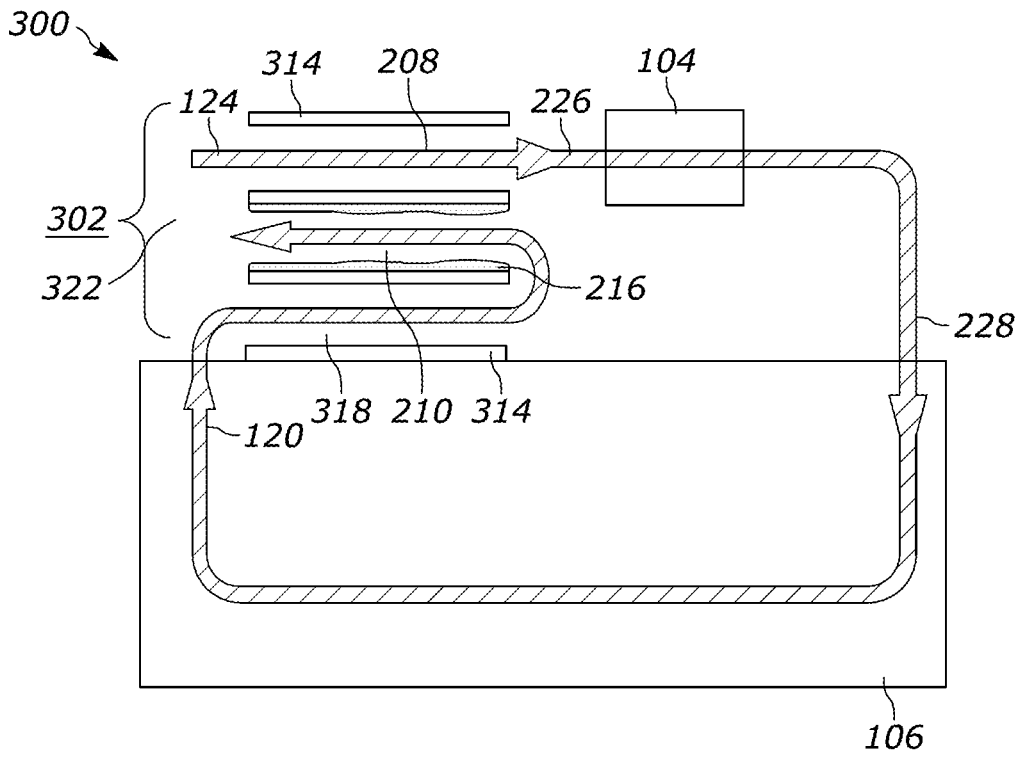
FIG. 3 displays a second embodiment of the system of FIG. 1 comprising a heat exchanger with a plurality of channels.

FIG. 3 shows a second embodiment of the air conditioning system 300, wherein the heat exchanger 302 comprises a second dry working channel 318 for additional pre-cooling of the exhaust air 120. As will be clear to one of skill in the art, any number of wet and/or dry channels may be used based on the desired capacity of the system.

In an embodiment of FIG. 3, the exhaust air 320 is delivered to the additional dry working channel 318 before moving on to the wet working channel 210. In this embodiment, the heat exchanger 302 comprises an alternating series of thermally coupled wet and dry working channels 208, 210, 318. In an embodiment, similar to the embodiment of FIG. 2, the walls 314 between the channels 208, 210, 318 are thermally coupled, such that a change in temperature on one surface of a wall 314 results in a corresponding change of temperature on an opposing surface of the same wall 314. In an embodiment, and similar to the embodiment of FIG. 2, the cycle is continuous and exhaust air 120 mixes with the outdoor ambient air 322 before it is then delivered to the working channels 208, 210 (as outdoor air 124) where the cycle begins again.

In an embodiment of FIG. 3, the air conditioning system 300 comprises the same elements and steps as the described embodiment of FIG. 2.

Figure 4:
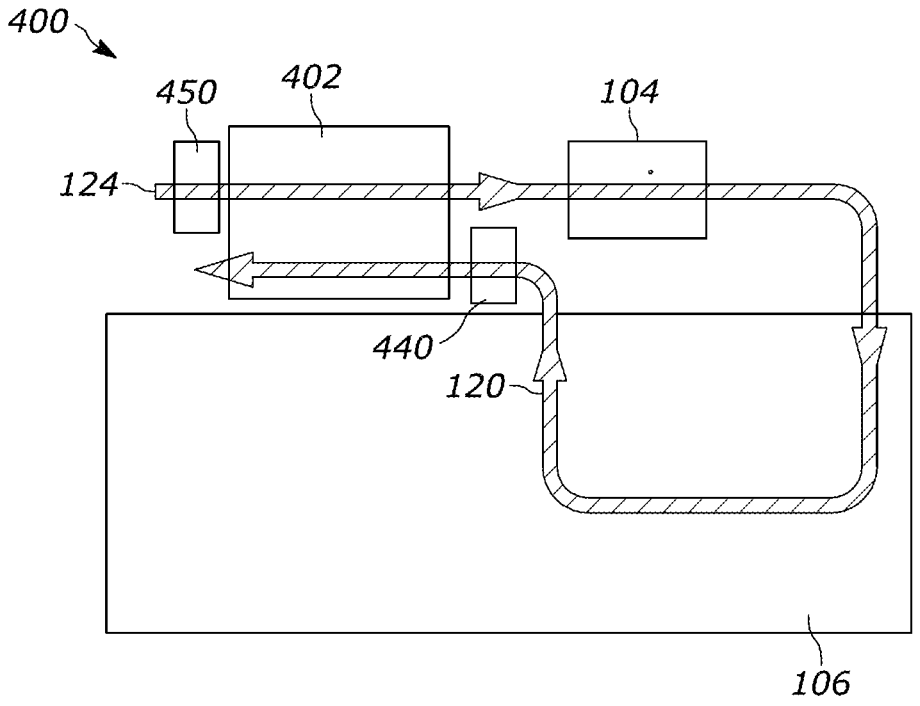
FIG. 4 displays a third embodiment of the system of FIG. 1 which includes exhaust and supply fans.

FIG. 4 shows a system 400 generally equivalent to the embodiment of FIG. 1 discussed above except as otherwise noted. In system 400, an exhaust fan 440 is placed along the path of movement of the exhaust air 120. The exhaust fan 440 functions to expel the exhaust 120 from the conditioned space 106 and drive it through the wet channel of the heat exchanger 402. Similarly, a supply fan 450 is placed along the path of movement of the outdoor air 124 into the dry channel of the heat exchanger 402. As will be clear to one of skill in the art, any number of exhaust fans 440 and supply fans 450 may be used depending on the requirements of the system. Further, the fans 450, 440 may be located at one or more points along the respective supply and exhaust air paths in order to effectuate the desired movement of air through the system. In an embodiment, only a single fan is used in order to effectuate the desired movement.

In the present disclosure, the heat exchanger 102, 202, 302, 402 acts passively on the exhaust and outside air. No energy is required for the cooling and dehumidification that occurs during the heat exchange process. In alternative embodiments, active cooling and dehumidification may also occur in the heat exchanger in addition to the passive cooling and dehumidification discussed above, thereby improving on the efficiency of traditional active cooling systems while still ensuring the desired degree of cooling is consistently provided.

Having thus described in detail preferred embodiments of the present disclosure, it is to be understood that the disclosure defined by the above paragraphs is not to be limited to particular details set forth in the above description as many apparent variations thereof are possible without departing from the spirit or scope of the present disclosure.

The invention claimed is:

1. An air conditioning system for conditioning air in a space, comprising:

a conditioned space;

a dehumidifier; and a heat exchanger comprising:

a first channel having a first inlet configured to intake exhaust air from the conditioned space and a first outlet configured to expel the exhaust air from the first channel to an outdoor environment;

a second channel having a second inlet configured to intake outdoor ambient air from the outdoor environment and a second outlet configured to deliver the outdoor ambient air to the dehumidifier;

wherein a wall of the first channel and an adjacent wall of the second channel form a shared, thermally coupled wall comprised of a single impenetrable plate;

wherein a first surface of the thermally coupled wall in the first channel is coated in a liquid such that the passage of the exhaust air through the first channel evaporates at a least a portion of the liquid coated on the first surface of the thermally coupled wall thereby reducing the temperature of the first surface of the thermally coupled wall;

wherein the evaporation of the liquid transfers heat between the first surface of the thermally coupled wall and a second surface of the thermally coupled wall disposed within the second channel such that reducing the temperature of the first surface of the thermally coupled wall reduces the temperature of the second surface of the thermally coupled wall and cools the outdoor ambient air traversing the second channel to create pre-cooled air;

wherein the dehumidifier dehumidifies the pre-cooled air received from the second channel to a desired condition and delivers conditioned air to the conditioned space; and wherein the conditioned air circulates within the conditioned space and exits the conditioned space as the exhaust air.

2. The air conditioning system of claim 1, wherein:

the first inlet is proximate a first end of the heat exchanger;

the first outlet is proximate a second end of the heat exchanger;

a second inlet is proximate the second end of the heat exchanger;

a second outlet is proximate the first end of the heat exchanger; and the outdoor ambient air drawn through the second inlet of the second channel comprises a mixture of outdoor air and the exhaust air expelled from the first outlet of the first channel.

3. The air conditioning system of claim 1, wherein the dehumidifier is selected from a group consisting of a membrane dehumidifier, desiccant dehumidifier, or mechanical compression dehumidifier.

4. The air conditioning system of claim 1, wherein the heat exchanger includes a third channel, wherein the third channel pre-cools the exhaust air before the exhaust air enters through the first channel.

5. The air conditioning system of claim 1, wherein the liquid is comprised of water.

6. The air conditioning system of claim 5, wherein the system further comprises a connection to an external water supply to replenish the water coated on the first surface of the thermally coupled wall.

7. The air conditioning system of claim 1, wherein the walls of the first channel and second channel are comprised of a plastic, metal, metal alloy, ceramic material, or combination thereof.

8. The air conditioning system of claim 1, wherein the air conditioning system further comprises:

an exhaust fan drawing the exhaust air from the conditioned room and into the first channel, and a supply fan drawing the outdoor ambient air into the second channel.

9. A method of conditioning a space by circulating air through a heat exchanger, dehumidifier, and a conditioned space, the method comprising the steps of:

drawing ambient air through a first dry channel of the heat exchanger to precondition the ambient air;

passing the preconditioned ambient air through the dehumidifier to produce conditioned air and delivering the conditioned air to the conditioned space;

passing the conditioned air through the conditioned space and directing the conditioned air out of the conditioned space as exhaust air;

moving the exhaust air from the conditioned space through a wet channel of the heat exchanger, the wet channel and first dry channel having a shared, thermally coupled wall, the exhaust air evaporating a liquid from a surface of the thermally coupled wall within the wet channel and reducing temperature of the first dry channel;

wherein the liquid coats the surface of the thermally coupled wall in the wet channel;

wherein the evaporation of liquid from the thermally coupled wall removes heat from the thermally coupled wall to reduce the temperature of the first dry channel; and wherein the reduction in temperature of the first dry channel pre-cools and partially dehumidifies the ambient air as it passes through the first dry channel prior to delivering the preconditioned ambient air to the dehumidifier.

10. The method of conditioning a space in claim 9, wherein the ambient air drawn through the first dry channel comprises a mixture of outdoor air from an outdoor environment and the exhaust air expelled from the wet channel.

11. The method of conditioning a space in claim 10, wherein the dehumidifier is selected from a group consisting of a membrane dehumidifier, desiccant dehumidifier, or mechanical compression dehumidifier.

12. The method of conditioning a space in claim 10, wherein the thermally coupled wall is comprised of a single impenetrable plate.

13. The method of conditioning a space in claim 12, further comprising a pre-cooling step wherein a second dry channel pre-cools the exhaust air before the exhaust air enters the wet channel.

14. The method of conditioning a space in claim 13, further comprising the step of replenishing supply of the liquid to the wet channel, wherein the wet channel includes a connection to an external supply of the liquid to replenish supply of the liquid in the wet channel.

15. A heat exchanger as a system for conditioning air, the heat exchanger comprising:

a wet channel to draw exhaust air from a conditioned room through an inlet and discharge the exhaust air through an outlet located on an opposite end of the wet channel;

a first dry channel sharing a thermally coupled wall with the wet channel, the first dry channel disposed to draw ambient air through an inlet and discharge the ambient air through an outlet located on an opposite end of the first dry channel and toward a dehumidifier; and wherein a surface of the thermally coupled wall within the wet channel is coated in a liquid; and wherein when the temperature of the exhaust air is less than the ambient air, passage of the exhaust air through the wet channel evaporates liquid from the thermally coupled wall to cool the wet channel, and the first dry channel transfers heat to the wet channel to modulate the ambient air to a desired condition as the ambient air passes through the first dry channel; and an operative connection between the dehumidifier and the conditioned room directs the ambient air through the dehumidifier to create dehumidified air which is delivered to the conditioned room and exits the conditioned room as the exhaust air.

16. The heat exchanger system of claim 15, the heat exchanger further comprising a second dry channel to pre cool the exhaust air before the exhaust air enters through the wet channel.

17. An air conditioning system for conditioning air in a space, comprising:

a heat exchanger comprising:

a first channel;

a second channel;

wherein a wall of the first channel and an adjacent wall of the second channel form a shared, thermally coupled wall;

a dehumidifier operatively connected to the second channel;

a conditioned space operatively connected to the first channel;

a first inlet proximate a first end of the first channel, the first inlet configured to draw conditioned air from the conditioned space;

a first outlet proximate a second end of the first channel, the first outlet configured to expel the conditioned air to an environment;

a second inlet proximate a first end of the second channel, the second inlet configured to intake ambient air from the environment;

a second outlet proximate a second end of the second channel, the second outlet configured to deliver the ambient air to the dehumidifier, wherein the dehumidifier dehumidifies the ambient air into conditioned air prior to delivering the conditioned air to the conditioned space; and a coat of liquid is disposed along walls within the first channel such that the conditioned air evaporates the liquid as the conditioned air passes through the first channel and reduces the temperature of the shared thermally coupled wall and wherein the second channel transfers heat through the thermally coupled wall to the first channel, reducing temperature of the second channel and pre-cooling the ambient air as it passes through the second channel.

18. The air conditioning system of claim 17, wherein the air conditioning system further comprises:

an exhaust fan to draw the conditioned air from the conditioned room and into the first channel, and a supply fan to draw the ambient air into the second channel.

19. The air conditioning system of claim 18, wherein the heat exchanger includes a third channel, wherein the third channel pre-cools the conditioned air after it exits the conditioned room and before the conditioned air enters the first channel.

* * * * *